US007165882B2

(12) United States Patent
Della Santa

(10) Patent No.: US 7,165,882 B2
(45) Date of Patent: Jan. 23, 2007

(54) DEVICE FOR PROTECTING ACCESS TO THE WINDING MECHANISM OF A POCKET WATCH

(75) Inventor: Richard Della Santa, La Chaux-de-Fonds (CH)

(73) Assignee: Manufacture Favre & Perret SA, Cret-du-Locie (CH)

( * ) Notice: Subject to any disclaimer, the term of this patent is extended or adjusted under 35 U.S.C. 154(b) by 0 days.

(21) Appl. No.: 11/261,918

(22) Filed: Oct. 31, 2005

(65) Prior Publication Data

US 2006/0109748 A1 May 25, 2006

(30) Foreign Application Priority Data

Nov. 22, 2004 (EP) ..... 04105981

(51) Int. Cl.
*G04B 3/00* (2006.01)
*G04B 5/00* (2006.01)
*G04B 23/00* (2006.01)

(52) U.S. Cl. ..... 368/147; 368/206; 368/214

(58) Field of Classification Search ..... None
See application file for complete search history.

(56) References Cited

U.S. PATENT DOCUMENTS

| | | | | |
|---|---|---|---|---|
| 156,356 A | | 10/1874 | Jacot | |
| 672,728 A | * | 4/1901 | Bannatyne | 368/146 |
| 1,144,827 A | * | 6/1915 | Eberhard | 368/206 |
| 2,575,437 A | * | 11/1951 | Ziebart | 368/147 |
| 2,687,002 A | * | 8/1954 | Nallinger | 368/206 |
| 3,747,328 A | * | 7/1973 | Winkler | 368/72 |

FOREIGN PATENT DOCUMENTS

| | | |
|---|---|---|
| DE | 32 449 | 7/1885 |
| DE | 20210345 U | 1/2003 |
| EP | 821294 A1 | 1/1998 |
| EP | 957415 A | 11/1999 |
| EP | 1280023 A | 1/2003 |
| FR | 21 113 765 | 6/1972 |
| TW | 446859 A | 7/2001 |
| WO | WO 1999/047984 A1 | 9/1999 |

* cited by examiner

*Primary Examiner*—Vit W. Miska
(74) *Attorney, Agent, or Firm*—Sughrue Mion, PLLC

(57) ABSTRACT

The present invention concerns a mechanical watch (1), preferably of the pocket watch type, wound by a key. More specifically, the present invention concerns a protective device for the aperture (6) allowing access to the winding mechanism of such a watch, particular to the winding stem (7). For this purpose, a moving element (8) is implemented, mounted around the stem (7) and able to move between two end positions, first of all to at least partially block the aperture (6) in normal use and, secondly, to release access to the winding stem (7) in order to wind the watch.

11 Claims, 2 Drawing Sheets

DEVICE FOR PROTECTING ACCESS TO THE WINDING MECHANISM OF A POCKET WATCH

FIELD OF THE INVENTION

The present invention concerns a mechanical watch comprising a case inside which there is housed a watch movement including means for accumulating mechanical energy and winding means. These latter enable mechanical energy to be supplied to the accumulation means and comprise a stem that is accessible from the exterior through an aperture in the case.

In particular, the present invention concerns a watch of the pocket watch type whose mechanical energy accumulation means are implemented in the form of a barrel spring, the winding stem being connected to the barrel spring directly or via mechanical trains.

BACKGROUND OF THE INVENTION

Watches of this type have been known for several centuries now. First of all, the winding stem was generally accessible through an aperture made in the watch dial for winding the movement. Prior to generalisation of watch crystals, the dial was typically protected by a cover to avoid damaging the hands or interfering with the working thereof when the watch was arranged in the user's pocket. Consequently, the inside of the watch case was capable of communicating with the external environment through the winding aperture, the movement also being protected by the same cover. Thereafter, since the use of watch crystals became common, watch movements were adapted to arrange the aperture in different area of the watch case from the dial, namely behind the case. Since this aperture exposing the interior of the watch case to the external environment was detrimental to the watch movement, it became common to install a cover to protect the back of the case, particularly the aperture allowing free access to the winding stem. New watch movement structures emerged later, which were wound using a winding stem-crown integrated in the watch. Such movements advantageously allow the movement to be wound without using a specific tool for this purpose, namely a winding key. Moreover, such movements allow the watch case to be completely closed and thus the watch movement to be protected from the external environment.

However, these days, certain watchmakers now wish to uphold the old tradition of pocket watches of the type that are wound with a key, these watches generally being for the top end of the market and made of gold. In such case, the fact of having a cover on the back of the watch case has a certain number of drawbacks. In fact, the construction of the case is not only more complex, particularly because of the hinge which is necessary to hold the cover on, but also more expensive because of the quantity of material required to make the cover. Moreover, certain watchmakers wish to design replicas of old watches, certain of which have an access to the winding stem on the back face without having a cover, these replicas advantageously respecting current manufacturing quality standards. In such case the watch movements are significantly exposed as regards the risk of dust penetrating the interior of the watch case.

SUMMARY OF THE INVENTION

It is an object of the present invention to overcome the aforementioned drawbacks of the prior art by proposing a mechanical timepiece respecting old construction standards while providing maximum protection of the watch movement as regards the external environment.

The present invention thus concerns a watch of the type indicated hereinbefore, characterized in that it comprises a moving part able to move between two end positions, elastic means being arranged inside the case so as to hold the moving element in a first rest position. In this position, the moving element cooperates with the case to at least partially obstruct the aperture. The second of the end positions of the moving element is a winding position in which at least the distal end of the stem is released sufficiently to wind the accumulation means.

Preferably, the moving element is arranged so as to move along the stem, guide means being provided. The guide means can be integral to the watch case and, in particular, made in the form of a bush concentric to the aperture and extending from the case to the area of the watch movement.

Moreover, the moving element can be made in the form of a ring threaded onto the stem and having a central hole the section of which, on the external side, is smaller than the section of the aperture of the case in order to obstruct the latter.

Owing to the structure according to the present invention, the aperture through which the winding stem is accessible from the exterior of the watch case has reduced dimensions compared to watches of the prior art. In fact, the ring mounted on elastic means, preferably a helical spring, acts like a piston around the winding stem. When the spring is in the rest or relaxed position, the ring is in the area of the aperture and partially blocks the latter. When a winding key is inserted into the aperture to carry out the winding operation, the end of the key exerts pressure on the ring and tends to compress the spring making the ring move down along the bush. From a certain stage of spring compression, the key is sufficiently meshed with the winding stem to be able to be driven in rotation and rewind the barrel spring of the watch.

Preferably, the ring has a first portion of generally cylindrical shape, located on the external side and with a substantially circular section and a slightly smaller diameter than the diameter of the aperture. The first portion is followed by a second portion of generally cylindrical shape with a substantially circular section having a larger diameter than the diameter of the aperture. Further, the length of the first portion is less than or equal, preferably equal to the thickness of the case in the area of the aperture. Because of this structure, the distal part of the ring, namely that located on the external side, is flush with the case when the spring is in its relaxed position to improve the aesthetical appearance of the watch.

According to a preferred embodiment, when the watch comprises means for guiding the movements of the ring, the axial guiding of the ring in relation to the bush is achieved via an annular sealing gasket, arranged inside an annular groove, arranged in the casing of the second portion of the ring. This feature not only improves the sensation experienced by the watch user when he inserts the winding key, but also limits the phenomenon of wear that can occur between the ring and bush.

BRIEF DESCRIPTION OF THE DRAWINGS

Other features and advantages of the present invention will appear more clearly upon reading the following detailed description of a preferred embodiment, made with reference to the annexed drawings, given by way of non-limiting example and in which.

DETAILED DESCRIPTION

Figure 1:
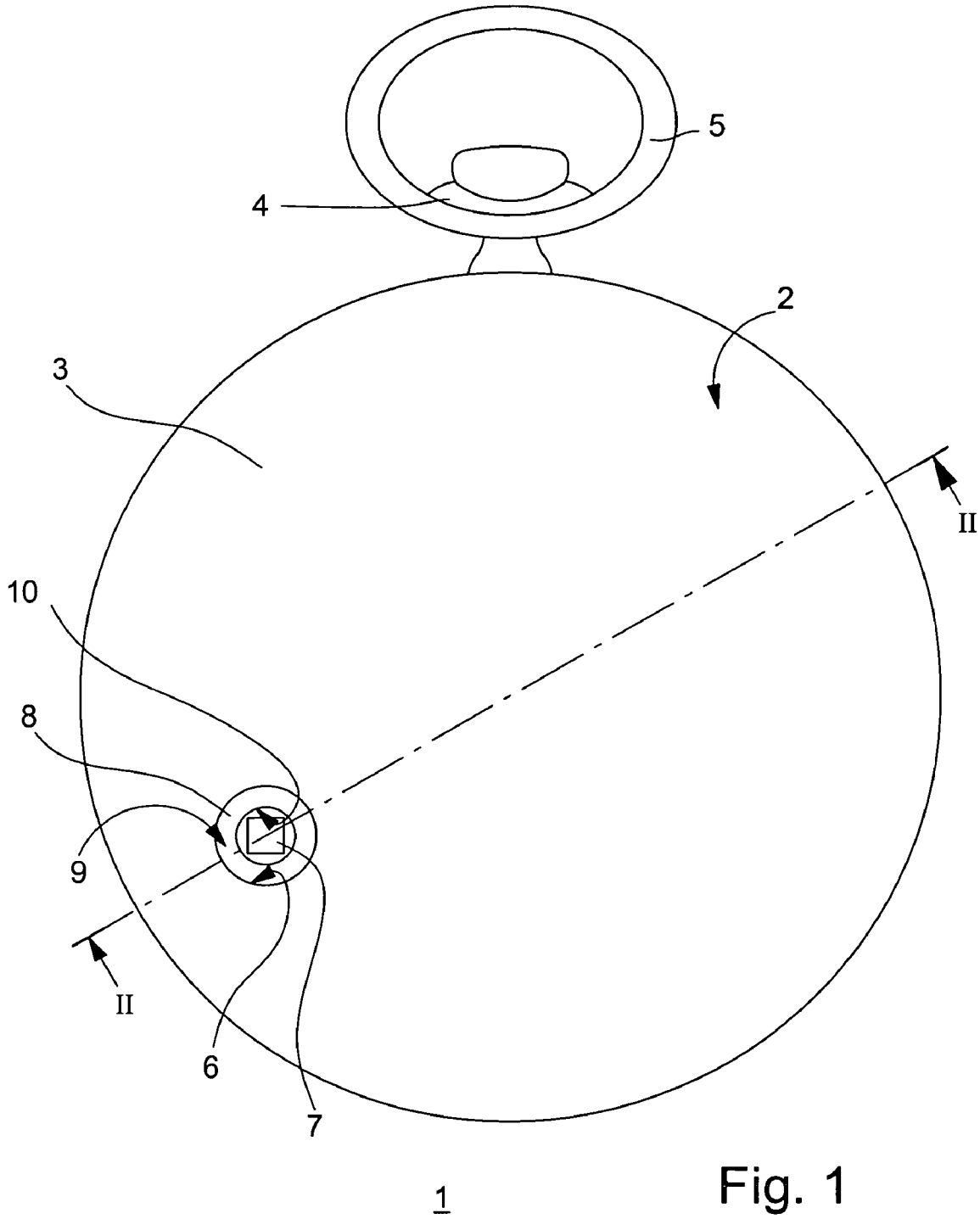
FIG. 1 shows a schematic elevation view of the back face of a mechanical timepiece according to the present invention.

FIG. 1 shows schematically an example of a preferred embodiment of a mechanical timepiece 1, or pocket watch, according to the present invention. Watch 1 is represented by its back face 2, in other words on the side of its back cover 3, the front face being neither shown nor described in detail insofar as it does not directly concern the heart of the present invention.

Watch case 1 is provided with a pendant 4, of a conventional type within the field of pocket watches, to which a bow 5 is secured.

Figure 2A:
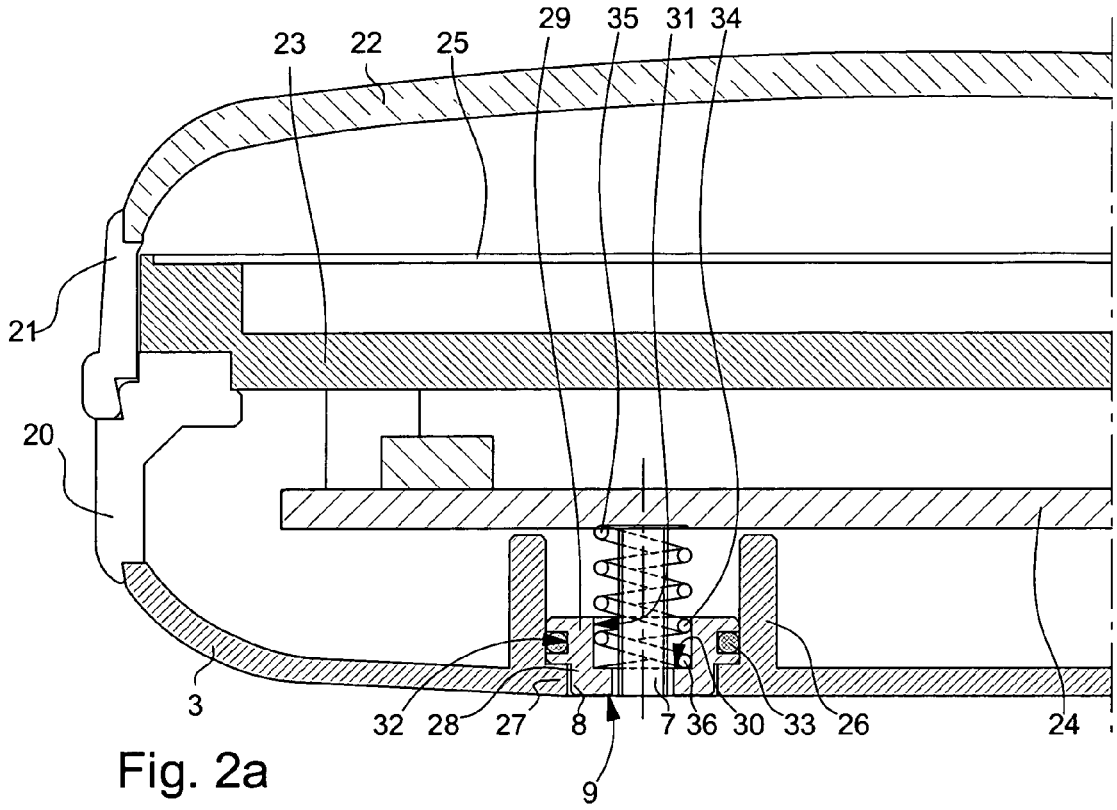
FIG. 2*a* shows schematically a cross-section of the timepiece along the line II—II of FIG. 1, in a first configuration.
Figure 2B:
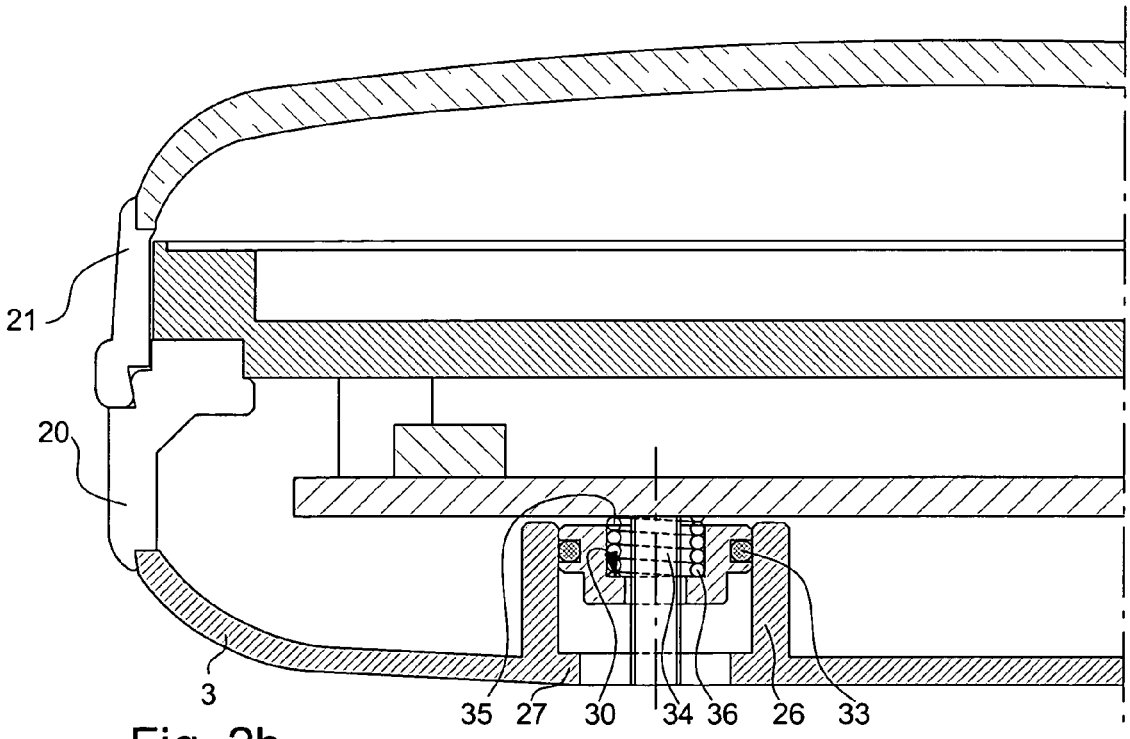
FIG. 2*b* shows a similar view to FIG. 2*a*, in a second configuration.

One area of the back face of watch 1 has an aperture 6 in which one end of a winding stem 7, of square section, is visible and accessible from outside the case. As is shown in FIGS. 2*a* and 2*b*, the distal end of stem 7 is located at aperture 6.

It will be observed in FIG. 1 that one element 8, whose external face 9 has the shape of a disc comprising a centred and substantially circular hole 10, is arranged between the edge of aperture 6 and stem 7. It is also apparent in this Figure that the presence of this element 8 reduces the dimensions of the passage existing between the exterior and interior of watch case 1. The diameter of hole 10 is slightly larger than the length of a diagonal of stem 7 such that the latter is free to rotate in relation to element 8.

A watch of the type shown is generally intended for the top end of the market. Thus, the constituent parts of the case, namely the back cover 3 and the middle part, and moving element 8 which has a portion visible from outside the case, are typically made of metal, preferably gold.

Element 8 forms an integral part of a device for protecting the pocket watch winding mechanism according to this preferred embodiment of the present invention. The other constituents of this protective device will now be described in more detail, in relation to the detailed description of FIGS. 2*a* and 2*b*.

FIG. 2*a* shows a partial simplified cross-section along the line II—II of FIG. 1, of watch 1 when moving element 8 is in a first end position, in which it protects the inside of the watch case.

FIG. 2*b* shows a similar view to that of FIG. 2*a*, in which moving element 8 is in a second end position for winding, releasing access to the end of winding stem 7.

In a conventional manner, watch 1 has a case, formed in particular of back cover 3, a middle part 20 and a bezel 21, and closed by a crystal 22. The watch case contains a watch movement, also of the conventional type, shown schematically in FIGS. 2*a* and 2*b* and, delimited on the one hand, by a plate 23 and on the other hand by train bars 24.

A dial 25 above which the time-indicating hands move (not shown) is mounted on the watch movement.

A bush 26, of generally cylindrical shape, secured to the bottom 20 of the case, is arranged concentrically to aperture 6 and to winding stem 7 and extends to the area of train bars 24. The inner diameter of the bush is slightly larger than the diameter of aperture 6, back cover 3 of the case thus forming a shoulder 27 at aperture 6.

Moving element 8 has the shape of a ring with a first cylindrical portion 28 located on the exterior side of watch 1 and whose length is substantially equal to the thickness of back cover 3 of the case. The diameter of the first portion 28 is slightly smaller than the diameter of aperture 6 such that, when ring 8 is in the first or rest position, first portion 28 overlaps inside aperture 6.

Towards the inside of the case, first portion 28 is followed by a second cylindrical portion 29, whose diameter is larger than that of the first portion and that of aperture 6.

Inside the ring, hole 10 ends in a shoulder portion 30 before being extended by a second hole 31 whose diameter is greater than that of hole 10.

Moreover, an annular groove 32 is arranged in the lateral wall of the second portion 29 to act as a housing for an annular O-ring type joint 33.

A helical spring 34 is threaded around winding stem 7 and extends between train bars 24 and ring 8. The external diameter of spring 34 is substantially larger than the diameter of second hole 31. Consequently, a first end 35 of spring 34 is arranged to abut against train bars 24 whereas the second end 36 of the spring is arranged to abut against the shoulder portion 30, inside ring 8.

From the preceding description, it is clear that ring 8 acts like a piston inside bush 26 which fulfils the corresponding cylinder function.

In fact, as is clear in FIG. 2*b*, when pressure is exerted on the outer face 9 of ring 8, the pressure is transmitted to the spring which is compressed to allow translation of the ring along stem 7 in the direction of the watch movement.

It should be noted that the presence of annular sealing gasket 33 on second portion 29 prevents friction occurring between the metallic parts of the watch, i.e. between the ring and the bush, during the movement of translation of the ring. Moreover, the sliding of the annular sealing gasket inside the bush provides a softer feeling for the user who exerts pressure on ring 8.

Ring 8 is thus capable of moving to a second end position, or winding position, in the area of train bars 24 and corresponding to the maximum compression of spring 34. Alternatively, the second end position of ring 8 can be defined by a shoulder arranged inside bush 26 or it can correspond to a position in which the ring directly abuts against train bars 24.

When the pressure exerted on the outer ring face 9 is released, spring 34 relaxes and pushes ring 8 back towards the exterior of the case to its first rest position. In this position, second portion 29 of the ring is arranged abutting against shoulder 27 of the case, outer ring face 9 being flush with the back face 2 of the watch case.

In an operation for winding the movement of watch 1, in particular the barrel spring (not shown), winding stem 7 is driven in rotation with a winding key (not shown). Consequently, the distal end of the stem, i.e. the end the furthest from the movement, is used as a male receptacle with which the winding key, carrying a hole forming the complementary female receptacle, will cooperate.

Starting from the rest position of ring 8, shown in FIG. 2*a*, the end of stem 7 is not accessible. The winding key thus has to be arranged abutting against outer ring face 9 in order to exert pressure on the ring and move it in the direction of the watch movement. At the same time, the end of stem 7 is inserted inside the hole of the key, so as to drive the stem in rotation with the key.

Owing to the protective device which has just been described, it appears that the inside of the case of watch 1, more particularly its watch movement, is better protected than the inside of prior art watches.

Indeed, in the most frequent configuration of the watch, i.e. when it is not being wound, ring 8 is arranged in its first position, i.e. at aperture 6 of the case. In this case, aperture 6, whose diameter is necessary to allow insertion of the winding key, is partially blocked by ring 8. Because of this, the risk of dust or dirt penetrating inside the case and damaging the movement is limited. Moreover, because it operates in a similar manner to a piston, the ring can easily be pushed back towards the inside of the watch case by using the key to wind.

It will also be noted, in particular in FIG. 2*b*, that annular sealing gasket 33 also blocks access to the inside of the case via the area located between ring 8 and bush 26.

According to a particular embodiment, a circular satin finishing operation can be carried out on outer face 9 of ring 8, such an operation being carried out in the same direction of rotation as the direction of rotation as the key during the winding operation. Thus, if outer face 9 is marked by the end of the winding key because of friction liable to occur during winding, the resulting scratches will at least partially merge with the satin finish lines to preserve the appearance of watch 1.

On the basis of the preceding description, an alternative embodiment can be envisaged more particularly as regards hole 10 of ring 8.

Hole 10 can in fact be square with very slightly larger dimensions than the dimensions of winding stem 7, which further limits the risk of dust penetrating inside the case. In such case, the ring also operates like a piston, being able to be pushed back in the direction of the watch movement to release at least the end of stem 7 before the watch is wound. The essential difference from the point of view of the winding operation occurs when the stem is being driven in rotation with a winding key. Because of the respective dimensions of the square hole according to this alternative embodiment and the stem, any rotation of the stem also causes a rotational movement of ring 8. The consequence of this is that the user has to exert a slightly greater torque on the key than that necessary in the first embodiment described hereinbefore.

Consequently, when this alternative is implemented, it is preferable to choose a material, for annular sealing gasket 33, such that the friction occurring when the sealing gasket slides against the inside of the bush is minimal. Conventional rubber or silicon based materials will preferably be used.

The preceding description corresponds to preferred embodiments of the invention and should in no way be considered as limiting, more particularly as regards the structure described for ring 8 and bush 26.

It is possible for bush 26 to have a similar diameter to the diameter of aperture 6, additional means then being necessary to hold ring 8 in its rest position, replacing shoulder 27.

In particular, an embodiment could be envisaged wherein the ring is directly guided by winding stem 7, the bush not being arranged in the case, which of course gives rise to substantially less efficient protection, but which may nonetheless prove sufficient depending upon the particular case. In particular, the loss of efficiency is less critical in this case when the hole of the moving ring has a square section whose dimensions are fitted to the dimensions of the winding stem. Likewise, when the bush is provided, it can be made in various alternative ways. It may, for example, be secured to train bars instead of to the case, or even be implemented in the form of simple guide stems arranged on either side of the winding stem. In this latter case, the ring is thus provided with holes adapted to the guide stems and arranged on either side of the central hole while being parallel thereto. Those skilled in the art will not encounter any particular difficulty in carrying out other minor adaptations of the watch without departing from the scope of the present invention.

What is claimed is:

1. A mechanical watch comprising a case inside which there is housed a watch movement including means for accumulating mechanical energy and winding means for providing mechanical energy to said accumulation means, said winding means comprising a stem that is accessible from the exterior through an aperture of said case, the stem being arranged to be driven in rotation with a winding key, wherein it comprises a moving element able to move between two end positions, elastic means being arranged inside said case so as to hold said moving element in a first rest position in which it cooperates with said case to block at least partially said aperture, the second of said end positions being a winding position in which at least the distal end of said stem is released sufficiently for said accumulation means to be wound, and in that the moving element is moved towards its winding position due to the pressure exerted by the winding key on the moving element.

2. The watch according to claim 1, wherein said moving element is able to move in translation along said stem.

3. The watch according to claim 2, wherein it further includes means for guiding said moving element.

4. The watch according to claim 3, wherein said guide means are secured to said case.

5. The watch according to claim 4, wherein said guide means include a bush concentric to said aperture and extending from said case substantially into the area of said watch movement.

6. The watch according to claim 1, wherein said moving element is a ring threaded around said stem, said ring having a central hole whose section on the external side is smaller than the section of said aperture.

7. The watch according to claim 6, wherein said aperture is of substantially circular shape, said ring having a first portion of generally cylindrical shape, located on the external side and of substantially circular section with a slightly smaller diameter than the diameter of said aperture, followed by a second portion of generally cylindrical shape and of substantially circular section with a larger diameter than the diameter of said aperture, the length of said first portion being smaller than or equal to the thickness of said case in the area of said aperture.

8. The watch according to claim 7, wherein said guide means include a bush concentric to said aperture and extending from said case substantially into the area of said watch movement, said bush having a substantially circular section, wherein an annular groove is arranged in the casing of said second portion, an annular sealing gasket being arranged partially inside said groove, the diameter of said second portion being substantially smaller than the inner diameter of said bush such that said sealing gasket is compressed between said second portion of said ring and said bush.

9. The watch according to claim 6, wherein said central hole of said ring is substantially circular.

10. The watch according to claim 1, wherein said elastic means include a helical spring inserted between said watch movement and said moving element.

11. The watch according to claim 10 wherein said moving element is a ring threaded around said stem, said ring having a central hole whose section on the external side is smaller than the section of said aperture, and wherein the external diameter of said helical spring is slightly smaller than the diameter of the hole of said ring on the side of the watch movement, said hole including an inner shoulder arranged at a distance from the end of said ring located on the watch movement side and against which one end of said spring is arranged to abut.

* * * * *